US005454751A

United States Patent [19]

Wiand

[11] Patent Number: 5,454,751

[45] Date of Patent: Oct. 3, 1995

[54] MARBLE, GRANITE AND STONE FINISHING AND ABRASIVE PADS THEREFOR

[76] Inventor: Ronald C. Wiand, 1494 Heatherwood, Troy, Mich. 48098

[21] Appl. No.: 355,116

[22] Filed: Dec. 13, 1994

Related U.S. Application Data

[63] Continuation of Ser. No. 259,940, Jun. 15, 1994, abandoned, which is a continuation of Ser. No. 871,569, Apr. 20, 1992, abandoned, which is a continuation of Ser. No. 502,056, Mar. 30, 1990, abandoned.

[51] Int. Cl.[6] ..... B24B 1/00

[52] U.S. Cl. ..... 451/526; 451/353

[58] Field of Search ..... 451/350, 353, 451/526, 530, 533, 538, 539

[56] References Cited

U.S. PATENT DOCUMENTS

| | | | |
|---|---|---|---|
| 816,461 | 3/1906 | Gorton | 51/395 |
| 3,098,329 | 7/1963 | Doran . | |
| 3,468,079 | 9/1969 | Kaufman | 51/395 |
| 4,617,767 | 10/1986 | Ali | 51/358 |
| 4,675,975 | 6/1987 | Kucharczyk et al. | 51/407 |
| 4,754,580 | 7/1988 | Mattson . | |
| 5,174,795 | 12/1992 | Wiand | 51/394 |

FOREIGN PATENT DOCUMENTS

| | | | |
|---|---|---|---|
| 2929479 | 2/1981 | Germany . | |
| 3342480 | 6/1985 | Germany . | |
| 52-32480 | 8/1977 | Japan | 51/402 |
| 1243288 | 8/1971 | United Kingdom . | |

*Primary Examiner*—Maurina T. Rachuba
*Attorney, Agent, or Firm*—Harness, Dickey & Pierce

[57] ABSTRACT

An improved method of finishing surfaces having irregular stepped portions or other edges and improved apparatus therefor. The method of the present invention includes rough finishing the surface by utilization, of a rotary tool with a first abrasive pad attached thereto. The first abrasive pad includes an abrasive body portion with an outer peripheral edge. A substantially flexible outer rim portion extends outward from the peripheral edge of the pad. According to a second step of the present invention, finished sanding of the surfaces is accomplished by utilization of a rotary tool with a second abrasive pad attached thereto. The second abrasive pad includes a backing substrate and at least one abrasive segment attached thereto. The total abrasive surface encompassed by the abrasive segment is from about 1% to about 30%. With the finishing pad of the present invention hydraulic suction is minimized thereby allowing greater forces to be placed on the abrasive pad for increasing abrasive cutting efficiency of a particular sized abrasive grit.

12 Claims, 3 Drawing Sheets

MARBLE, GRANITE AND STONE FINISHING AND ABRASIVE PADS THEREFOR

This is a continuation of U.S. patent application Ser. No. 259,940, filed Jun. 15, 1994 now abandoned, which is a continuation of application Ser. No. 871,569, filed Apr. 20, 1992, now abandoned, which is a continuation of application Ser. No. 502,056, filed Mar. 30, 1990 now abandoned.

BACKGROUND OF THE INVENTION

The present invention relates to a method and apparatus for finishing of irregular surfaces. More specifically, the present invention relates to an improved method and abrasive pads for finishing of marble, granite, stone or other irregular surfaces which have stepped portions, edges, lips or the like which must be traversed during the abrading or finishing operation.

Rotary abrasive tools are commonly in use in many sanding and grinding operations. Generally, abrading assemblies used in these rotary tools include a backing substrate, such as a foam pad or a rubber backing mat or the like, and an abrading pad which can be temporarily attached and replaced as the pad wears out during the finishing operation. The use of such a tool has many advantages including quickness of cutting and easy replacability of the abrasive pads. However, it has always been a problem in the use of rotary tools that during grinding of irregular large flat areas, i.e. greater than the surface area of the pad, the pads tend to deteriorate quickly and/or leave an irregular surface due to gouging and the like because of contacting the irregularities in the surface.

While many grinding situations have irregular surfaces which tend to tear or break up the pad or cause surface deformities therein, a particularly problematic area today has been in the finishing or refinishing of floors which are constructed with tiles or stones laid in a mortar base. Such floors have many edges to traverse during finishing thereof. This is partially because of the spaced stone edges and partially because the stones are invariably seldom co-planar one to another over the floor surface.

Floor finishing units are commonly utilized in finishing or reconditioning such floors. Such units include three rotating planetary heads and have a base which also rotates to provide an even finish to flat surfaces such as floors. In these units, various coarseness abrasive pads are used on each of the heads for sanding and final finishing of the floor. In the past, this has been problematic in that relatively stiff pads where commonly used. Often times while such a stiff pad is traversing the lip, step or edge from one floor stone to another the lack of flexibility in the pad would cause gouging of the adjacent stone when the pad was canted at the transition area. This reduced the quality of the finish. On the other hand, when relatively flexible pads are used on such rotary tools the useful life of the pad is substantially reduced. This is so because when encountering unfinished edges or steps from stone to stone, the edge of the pad catches on the edges and will tend to be shredded quickly. This tends to deteriorate the pad very rapidly and make such flexible pads undesirable due to the down time incurred.

Because of these problems, in the past it has been common to utilize various grit stones or pads and go over the floor surface five to six times before creating the final finish. This is a very labor intensive and time consuming process.

In the past, in addition to the above complications, it has also been a complication that when reaching a final finished surface the pads used and the grains used for finishing this surface tended to create a hydraulic suction during the final finishing steps. Such hydraulic suction conditions require rapid replacement of pads due to loading up of the pads. Hydraulic suction conditions may also cause stalling of the finishing machine, thus slowing down the finishing process.

Thus, in the past the common finishing systems used for such applications were labor intensive, extremely costly and time consuming and did not always produce the desired results. Therefore, it has been a goal in the art to improve upon prior art methods of finishing such granite and stone floors and the abrasive pads which are useful therein.

Therefore, it is an object of the present invention to provide an improved method for finishing of irregular surfaces having a step portion or other edges therein.

It is still further an object of the present invention to provide an improved rotary grinding pad which can traverse such irregular structures without damage to the pad thereby improving the pad life during these operations and saving man hours.

It is still further an object of the present invention to provide a finishing pad which is resistant to hydraulic suction during the grinding operation such that improved cutting is provided.

SUMMARY OF THE INVENTION

In accordance with these goals and objectives there is provided, according to the present invention, an improved method of finishing surfaces having irregular stepped portions or other edges and improved apparatus therefore. The method of the present invention includes rough finishing the surface by utilization of a rotary tool with a first abrasive pad attached thereto. The first abrasive pad includes an abrasive body portion with an outer peripheral edge. A substantially flexible outer rim portion extends outward from the peripheral edge of the pad. According to a second step of the present invention, finished sanding of the surfaces is accomplished by utilization of a rotary tool with a second abrasive pad attached thereto. The second abrasive pad includes a backing substrate and at least one abrasive segment attached thereto. The total abrasive surface encompassed by the abrasive segment is from about 1% to about 30%. With the finishing pad of the present invention hydraulic suction is minimized thereby allowing greater forces to be placed on the abrasive pad for increasing abrasive cutting efficiency of a particular sized abrasive grit, Additional benefits and advantages of the present invention will become apparent from the subsequent description of the preferred embodiment taken in conjunction with the accompanying drawings.

Figure 3:
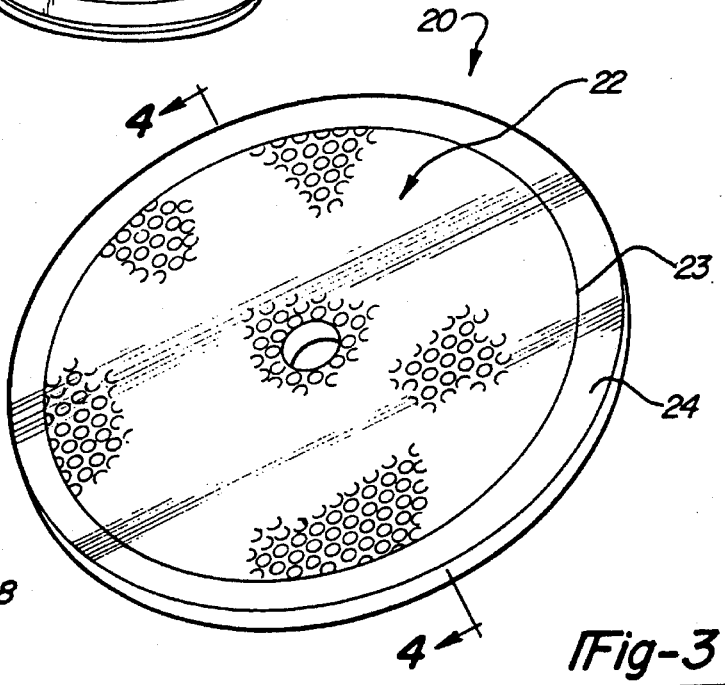
FIG. 3 is a plan view showing a rough abrasive grit pad structure made in accordance with the teachings of the present invention.
Figure 4A:
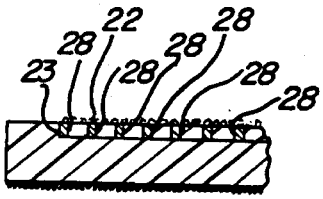
FIG. 4 is a cross-sectional view taken along line 4—4 of FIG. 3.
Figure 4:
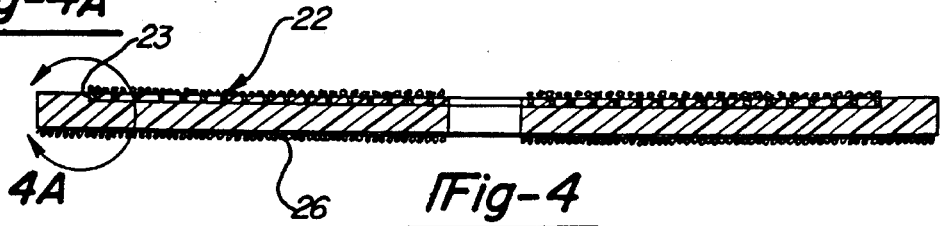
Figure 5:
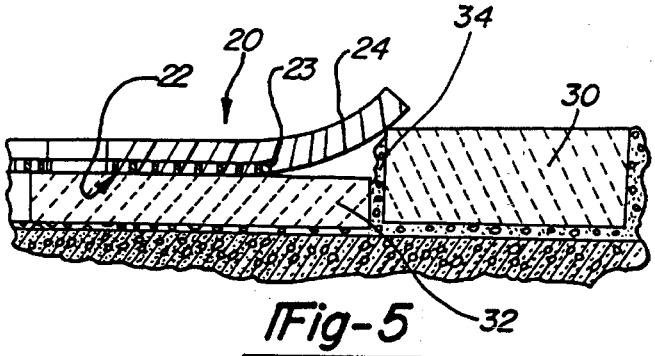
Figure 6:
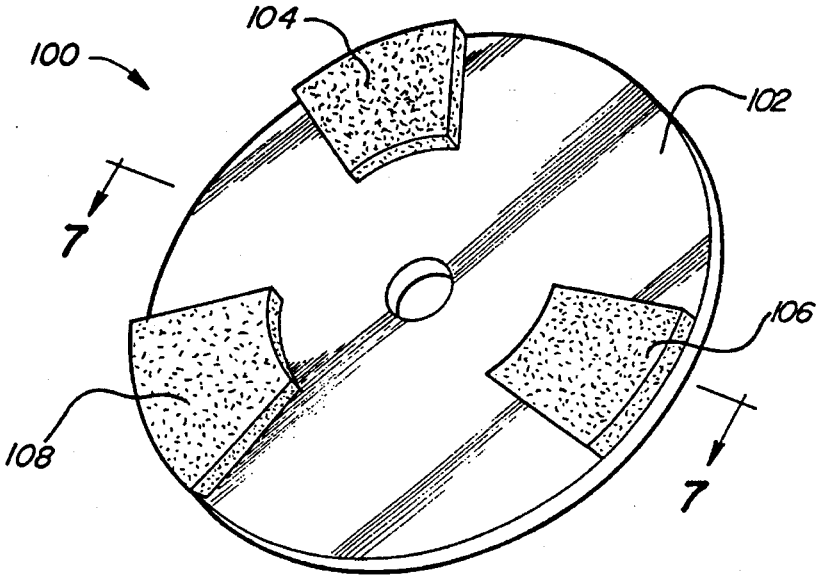
Figure 7:
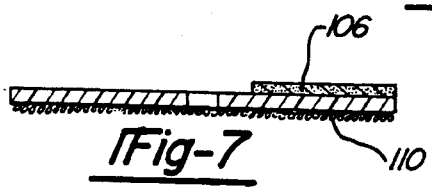
Figure 8:
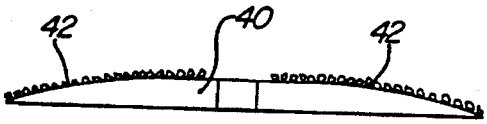
Fig-8 PRIOR ART
Figure 9:
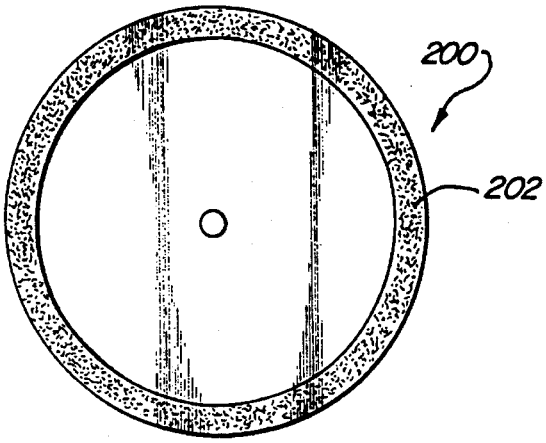
Figure 10:
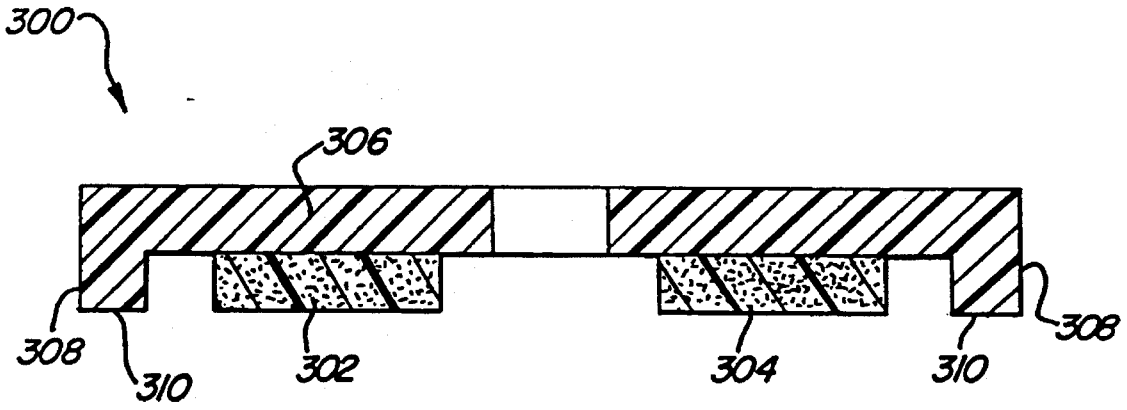
Figure 11:
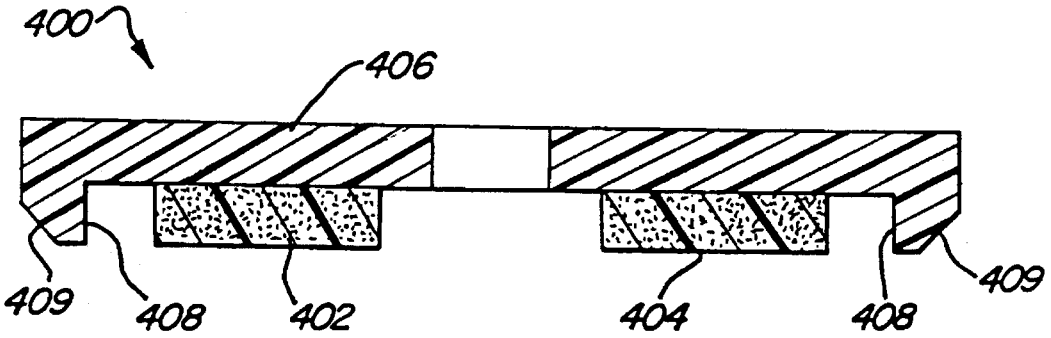

FIG. **4*a* is a detailed sectional view of the rim portion in circle 4*a* of FIG. 4**;

FIG. 5 is an illustrative sectional view showing the pad of FIG. 3 in its operational environment;

FIG. 6 is a perspective view showing a finishing pad structure made in accordance with the teachings of the present invention;

FIG. 7 is a sectional view of the Dad structure of FIG. 6 taken along line 7—7 of FIG. 6;

FIG. 8 is a view of a prior art abrasive pad;

FIG. 9 a plan view of an alternate embodiment of a finishing pad structure of the present invention;

FIG. 10 is a sectional view of an alternate embodiment of a finishing disc useful for sanding over irregular surfaces; and FIG. 11 is a sectional view of a finishing disc similar to FIG. 10 but having a ramped surface at the lip portion.

DETAILED DESCRIPTION OF THE PREFERRED EMBODIMENTS

Figure 1:
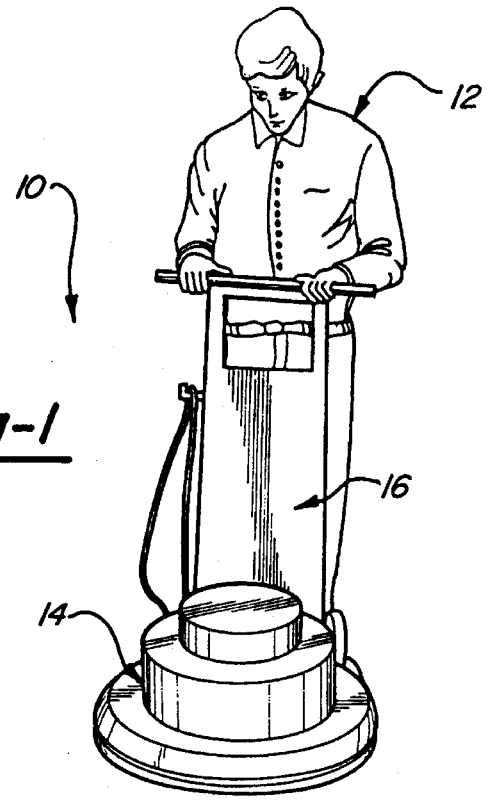
FIG. 1 is a perspective view showing a typical floor finishing apparatus and user.

Referring now to FIG. 1, there is shown a typical floor finishing apparatus 10 which is manually operated by an operator 12. The finishing apparatus 10 includes a sanding head portion 14 and a handle portion 16.

Figure 2:
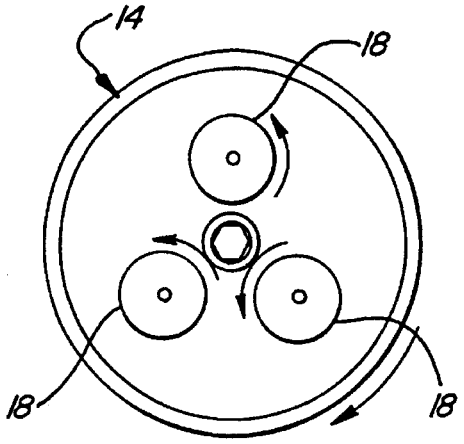
FIG. 2 is a bottom view showing the functional aspects of the floor finishing apparatus of FIG. 1.

Referring to FIG. 2, the sanding head generally includes three planetary heads 18 which rotate independently at about 800 rpm and an outer rotational portion which rotates all three heads at about 170 rpm. Such a unit is designed to provide even sanding. However, due to the irregularities in the marble floor surface to be sanded prior art pads needed frequent replacement. Because the pads are not flexible due to the interaction between the pads and the edges in the floor, the pads tend, at times, to gouge the floor when canted between surfaces on different planes.

Referring now to FIGS. 3, 4 and 4*a*, there is provided an improved first rough finishing pad 20, made in accordance with the teachings of the present invention, which is useful in such an operation and has prolonged life and reduces the time necessary to finish such a floor. The pad 20 includes a central abrasive body portion 22 which has an outer peripheral edge 23. A substantially flexible outer guide rim portion 24 is provided which extends outward from the peripheral edge 23. Also included is a means such as VELCRO® hook and loop attachments 26 for attachment of the pad to the planetary head 18 of the floor sander. The abrasive body portion 22 may be of any of a number of known types. For instance, whole or perforated sheet metal structures with abrasive grit brazed, electroplated or otherwise attached thereto may be utilized in the present invention. Other structures such as sintered abrasive grit structures may also be utilized in the present invention. In a preferred embodiment a flexible abrasive member is provided which includes a metal sheet with apertures 28 therethrough and has an abrasive grit brazedly attached on the operative surface. Thus, abrasive grit structures such as meshes and the like are also anticipated to be useful in the abrasive pad of the present invention.

In accordance with the present invention, an outer rim member 24 is provided which is flexible such that it guides the rotating abrasive pad onto a stepped portion or over an edge. The portion 24 is preferably substantially non-abrasive in that if the pad should tilt or cant during the sanding process the portion 24 will not tend to bite into the surface being finished and will support the edge 23 of the abrasive body portion 22 off the surface. Thus, such a rim 24 could be hingedly attached to the pad structure or otherwise attached such that it will flex in an upward direction when it contacts an edge or step portion or to provide a smooth transition to the next floor stone or the like, thus saving the actual abrasive structure from damage during operation and greatly lengthening the abrasive pad's life while reducing any propensity for gouging of the finished surface.

As shown in FIG. 5, there is an illustration of an operative environment of a pad 20 as utilized in the present invention. As shown in FIG. 5, a pair of spaced floor blocks 30 and 32 made of a marble or granite material are set in a mortar material 34. During the sanding of these blocks a pad 20 made in accordance with the teachings of the present invention having the guide rim 24 will tend to abut the non-aligned stone portions 32 and the flexible rim 24 will flex upward in order to provide a guide surface for the pad 20 to provide a smooth transition to the next stone 32 for the abrasive body portion 22 without providing any loads which would force the edge of the abrasive 22 into the surface.

In accordance with a preferred embodiment, the rim portion 24 is provided by embedding an abrasive body portion 22 into a polymer material. A preferred polymer material is a polypropylene material. In a preferred embodiment the pad is made in a round configuration and the central abrasive element is of less of a diameter than the diameter of the polymer material to provide a rim portion 24 which has a width of from about ¼ to about ½ inch. Such a pad may be advantageously produced by embedment techniques set forth in my co-pending U.S. patent application Ser. No. 474,373, filed Feb. 2, 1990, entitled "Abrasive Sheet and Method", the specification and teachings of which are hereby incorporated herein by reference thereto.

Thus, in accordance with a method of the present invention a floor or other irregular surface having an edge or step portion may be advantageously "rough" sanded by utilizing the pad 22 made in accordance with the teachings of the present invention. This has the advantage that edges are quickly taken off and the pad has great longevity during the sanding operation.

Referring to FIG. 8, a prior art abrasive pad is shown which addresses the same problem. In the prior art abrasive pad a single pad element 40 is provided which includes ramped or curved surfaces 42 at its outer edge to incorporate a ramp that was believed to traverse such steps. However, in the prior art this pad had to be a non-flexible pad or otherwise it would deteriorate rapidly. Because of the non-flexibility of the pad when the ramp surfaces 42 traverse the edge or step the opposite edge of the pad would tend to cut into the working surface thereby leaving undesirable gouges in the finished surface. Thus, in the present invention this problem is remedied in that the lip 24 is flexible to provide a proper transition surface and if any canting of the abrasive pad should occur the lip 24 is also non-marring and flexible, such that the transition stone will not be adversely affected during this transition.

In accordance with the second finishing step and the second apparatus of the present invention for finishing the surface prepared in accordance with the first step, there is provided a rotary finishing abrasive pad, 100 for finishing of a smooth surface with substantially reduced hydraulic suction. The pad 100 includes a backing substrate 102 with at least one abrasive segment 104 attached to the pad. It is critical in the present invention that in order to provide anti-hydraulic suction effects the total abrasive surface of the abrasive segment available to the final finish surface is from about 1% to about 30%. Typically, the total abrasive surface must be from about 1.5% to about 15% and preferably is from about 2% to about 5% of the pad surface. These areas are critical to the present invention in that if hydraulic suction is minimized greater forces may be used on the abrasive pad for increasing the abrading efficiency of particularly the fine sized abrasive grits. In a preferred embodiment of the present invention, three sediments are provided which are trapezoidally shaped and are evenly spaced about the periphery of the backing substrate 102. The abrasive segments are preferably formed by known processes into resinous diamond matrix abrasive segments as are known to those skilled in the art which may be molded and attached to the substrate by glues, adhesives or the like.

The backing substrate 102 may be any type of a flexible type of backing substrate 102 such as a fabric or other material. The VELCRO® hook and loop fastener is attached to the back of the substrate 102. Preferably, the backing substrate is a nema G-3 grade phenolic board material or a polypropylene material.

Referring now to FIG. 9, there is shown an alternate embodiment of a finishing pad made in accordance with the teachings of the present invention. The pad 200 includes an outer peripheral abrasive rim portion 202 to provide the proper surface area in the guidelines set forth above. While such a pad structure will effectively reduce the hydraulic suction accompanying the use of these pads the plurality of segments shown in FIGS. 6 and 7 is preferred in that the swarf material generated during finishing operations is easily evacuated from the structure during finishing operations.

Referring now to FIG. 10, there is shown an alternate embodiment of a finishing pad 300 useful in finishing irregular surfaces. In some applications it may be necessary to finish a surface which has not been rough sanded to remove the edges, steps or the like prior to finishing sanding. In such circumstances these edges may be damaging to the segments of the previous embodiments 100 and 200. Like these embodiments the finishing pad 300 is preferably a disc shape and includes abrasive segments 302 and 304 attached to a backing substrate 306 which has abrasive surface areas in the ranges previously set forth. The finishing pad 300 of this invention incorporates an axially extending lip portion 308 which extends from a portion of the backing substrate radially outside the segments 302 and 304. Lip portion 308 is for protection of the segments when contacting edges or the like of the floor surface. Preferably, the lip portion 308 extends around the entire periphery of the disc and extends in an axial direction such that the axially outer surface 310 is even with the abrading surface of the segments 302 and 304. Preferably, the backing substrate 306 and the lip portion 308 are made of a single material such as a molded polypropylene. It is preferred that the backing material used is flexible such that as the segments 302 and 304 wear down the backing substrate 306 and/or the lip 308 will flex to allow contact of the abrasive segments with the surface to be finished.

Referring to FIG. 11, there is shown an alternate embodiment of a finishing pad 400 which is similar to FIG. 10 in that it includes abrasive segments 402 and 404 attached to backing substrate 406. The finishing pad 400 differs from the previous embodiment 300 in that the axially extending lip portion 408 has a canted ramp surface 409 which assists in traversing edges, steps and other irregular surfaces.

Thus, the lip portions 308 or 408 allow the pad to traverse up over a step or edge to even the segments with the step or edge to protect the segments from damage or improper wear and to prevent damaging contact of the segments with the edge.

It has been discovered that through the use of the finishing pad structure set forth above, the hydraulic suction which impairs the use of other prior art structures is greatly reduced to such an extent that a smaller abrasive grit size can be used for finishing than would otherwise be anticipated while maintaining the cutting or finishing time of the operation. Thus, it is anticipated that a 200/230 grit resin bonded diamond segment material could be used to replace a much coarser grain standard abrasive pad. Thus, a pad of the present invention will cut at the rate of a coarser grain but will give the finish of a fine grain ready for final polishing.

In accordance with prior art processes it was required to first use a 36 grit or coarser abrasive stone, then a 60 grit stone, then a 100 grit stone, then a 150 grit stone, then a silicon carbide coated screen in order to provide the full finishing operation. Whereas in the present invention the original disc 20 may include a 120/140 sized diamond mesh disc to rough grind to remove lips, holes and the like in the surface and, thereafter only a second step is required to finish sand the surface using the grinding pad 100 or 200 as set forth above to produce a final surface suitable for polishing. Thus, reducing a five step process to a two step process.

Thus, due to my present method the prior art process took approximately five minutes per square foot to accomplish the same operation that my present pads and methods would accomplish in one minute per square foot. Due to the fact that such operations are generally labor intensive, a five fold decrease in the amount of time required to accomplish the same operation as the prior art substantially decreases the cost involved in accomplishing the operation. Thus, from purely a cost standpoint the method and apparatus of the present invention provided a great improvement over prior art processes and apparatuses used. In addition, because the pads and structures incorporated herein are energy efficient and do not readily destruct under similar conditions which would destruct prior art pads, the down time costs are reduced and replacement costs for pads are reduced.

It will be readily appreciated by those skilled in the art that the articles and methods of the present invention can be used in many areas other than floor polishing. For instance, a pad structure 20 made in accordance with the teachings of the present invention would be useful for sanding and grinding in auto body work or the like where cracks, crevasses and corners could catch a normal abrasive pad and rip it. The pads 100, 200, 300 and 400 or other pads made in accordance with the teachings of the present invention likewise would be useful in other areas where hydraulic suction could be a problem.

While the above description constitutes the preferred embodiments of the present invention, it is to be appreciated that the invention is susceptible to modification, variation and change without departing from the proper scope and fair meaning of the accompanying claims.

What is claimed is:

1. An abrasive pad for smooth transition during abrading of hard uneven surfaces which are substantially unyielding or the like used in combination with a floor sander including a mechanism for applying sanding motion to a floor and an attachment for attaching the abrasive pad to the mechanism said abrasive pad comprising:

a first abrasive body portion having an outer peripheral edge; and a second substantially flexible outer rim portion extending axially outwardly along a plane defined by the first abrasive body portion and from said outer peripheral edge attached to the body portion for supporting the body portion from initially contacting an uneven work surface which the rim portion comes into contact with, said second portion for flexing in response to encountering an uneven surface prior to said outer peripheral edge reaching the uneven surface for guiding of said outer peripheral edge and said abrasive body portion over the uneven surface without allowing separation of said rim portion from said outer peripheral edge which could cause gouging of the uneven surface thereby providing a smooth transition thereover.

2. The rotary abrasive pad of claim 1 wherein said first abrasive body portion is circular.

3. The rotary abrasive pad of claim 2 wherein said second outer rim portion is a substantially non-abrasive concentric ring of a polymer material.

4. The rotary abrasive pad of claim 1 wherein the first abrasive body portion is made of a first material and the rim portion is made of a second material.

5. The rotary abrasive pad of claim 4 wherein said first material is a metal material with at least a mono-layer of abrasive grit attached thereto and said second material is a polymer material.

6. The rotary abrasive pad of claim 5 wherein said first abrasive body portion is embedded in the polymer material.

7. The rotary abrasive pad of claim 6 wherein said polymer material is a polypropylene.

8. The rotary abrasive pad of claim 1 wherein said means for attachment is the hook or loop side of a hook and loop fastener.

9. An abrasive pad for smooth transition during abrading of uneven surfaces which are substantially unyielding used in combination with a floor sander including a mechanism for applying sanding motion to a floor and an attachment for attaching the abrasive pad to the mechanism said abrasive pad comprising:

a first abrasive sheet body portion including at least a monolayer of diamond hardness abrasive material brazedly attached to a metal surface thereof for forming a substantially co-planar abrasive surface having an outer peripheral edge, said body portion being imbedded in a backing substrate for forming an integral assembly, said backing substrate having portions thereof defining a second substantially flexible outer rim portion extending axially outwardly along a plane defined by the first abrasive body portion and from said outer peripheral edge with a surface thereof which is continuous from and co-planar with said abrasive surface, said second portion for deflection outside of the plane of said body portion in response to encountering an uneven surface prior to said outer peripheral edge reaching the uneven surface for guiding of said outer peripheral edge and said abrasive body portion over the uneven surface thereby providing a smooth transition thereover, said pad being able to withstand the forces of a rotary floor sander or the like without said portions defining said second substantially flexible outer rim portion separating from said first abrasive body portion.

10. An abrasive pad for smooth transition during abrading of hard uneven surfaces which are substantially unyielding or the like used in combination with a floor sander including a mechanism for applying sanding motion to a floor and an attachment for attaching the abrasive pad to the mechanism said abrasive pad comprising:

a first abrasive body portion having an outer peripheral edge; and a second substantially flexible outer rim portion extending axially outwardly along a plane defined by the first abrasive body portion and from said outer peripheral edge, said second substantially flexible outer rim portion being integrally attached to the body portion and inseparable therefrom for supporting the body portion from initially contacting an uneven work surface which the rim portion comes into contact with, said second portion for deflecting in a direction outside the plane of the abrasive body portion thereby forming an angled guide surface in response to encountering an uneven surface prior to said outer peripheral edge reaching the uneven surface for guiding of said outer peripheral edge and said abrasive body portion over the uneven surface without allowing separation of said rim portion from said outer peripheral edge which could cause gouging of the uneven surface thereby providing a smooth transition thereover.

11. A rotary abrasive pad for smooth transition during abrading of stone floor surfaces having uneven unyielding edges or the like used in combination with a floor sander including a mechanism for applying sanding motion to a floor and an attachment for attaching the abrasive pad to the mechanism said abrasive pad comprising:

a first abrasive body portion having an outer peripheral edge; and a second substantially flexible outer rim portion extending axially outwardly along a plane defined by the first abrasive body portion and from said outer peripheral edge, said second substantially flexible outer rim portion being integrally attached to the body portion and inseparable therefrom for supporting the body portion from initially contacting an uneven work surface which the rim portion comes into contact with, said second portion for deflecting in a direction outside the plane of the abrasive body portion thereby forming an angled guide surface in response to encountering an uneven surface prior to said outer peripheral edge reaching the uneven surface for guiding of said outer peripheral edge and said abrasive body portion over the uneven surface without allowing separation of said rim portion from said outer peripheral edge which could cause gouging of the uneven surface thereby providing a smooth transition thereover; and a velcro means for attachment of said pad to a rotary tool.

12. A rotary abrasive pad for smooth transition during abrading of stone floor surfaces having uneven unyielding edge surfaces or the like used in combination with a floor sander including a mechanism for applying sanding motion to a floor and an attachment for attaching the abrasive pad to the mechanism said abrasive pad comprising:

a first abrasive body portion having an outer peripheral edge;

a means integrally attached and extending axially outwardly along a plane defined by the first abrasive body portion and from said outer peripheral edge for flexing in a direction outside of the plane of the abrasive body in response to contact with an edge surface of a workpiece thereby forming an angled guide surface in response to encountering said edge surface prior to said outer peripheral edge of said first abrasive body portion reaching said edge surface for guiding of said outer peripheral edge and said abrasive body portion over said edge surface without allowing separation of said abrasive body and thus contact of said edge of said workpiece with said outer peripheral edge which could cause gouging of the edge surface of a workpiece for providing a smooth transition thereover; and a velcro means for attachment of said pad to a rotary tool.

* * * * *